United States Patent [19]

Uttley et al.

[11] Patent Number: 4,587,781

[45] Date of Patent: May 13, 1986

[54] TRIM PIECE FOR SUSPENDED CEILINGS

[76] Inventors: Larry G. Uttley; Franklyn L. Webb, both of 8314 Spring Valley, Belton, Mo. 64012

[21] Appl. No.: 607,582

[22] Filed: May 7, 1984

[51] Int. Cl.[4] ..... E04H 1/00

[52] U.S. Cl. ..... 52/242; 52/288; 52/732; 52/716

[58] Field of Search ..... 52/242, 241, 238.1, 52/461, 483, 484, 732, 468, 464, 716, 288, 821

[56] References Cited

U.S. PATENT DOCUMENTS 2,727,248 12/1955 Switzer ..... 52/468 X
4,074,478 2/1978 Rutherford ..... 52/288 X
4,361,994 12/1982 Carver ..... 52/238.1

FOREIGN PATENT DOCUMENTS 636448 2/1962 Canada ..... 52/242

*Primary Examiner*—Carl D. Friedman
*Assistant Examiner*—Naoko N. Slack
*Attorney, Agent, or Firm*—Kokjer, Kircher, Bradley, Wharton, Bowman & Johnson

[57] ABSTRACT

A trim piece for the joints formed between a suspended ceiling and an upright partition. The partition has a framework formed by vertical studs and an overhead wall track secured to T-bars which form a grid for supporting ceiling tiles. The trim piece has a flat body which fits closely in a crack formed between the wall track and overlying ceiling tile. A downturned tongue on the trim piece is sandwiched between a side flange of the wall track and wallboard which is applied to the framework of the partition. The only exposed part of the trim piece is a flange which projects through the space between the wallboard and ceiling tile.

20 Claims, 7 Drawing Figures

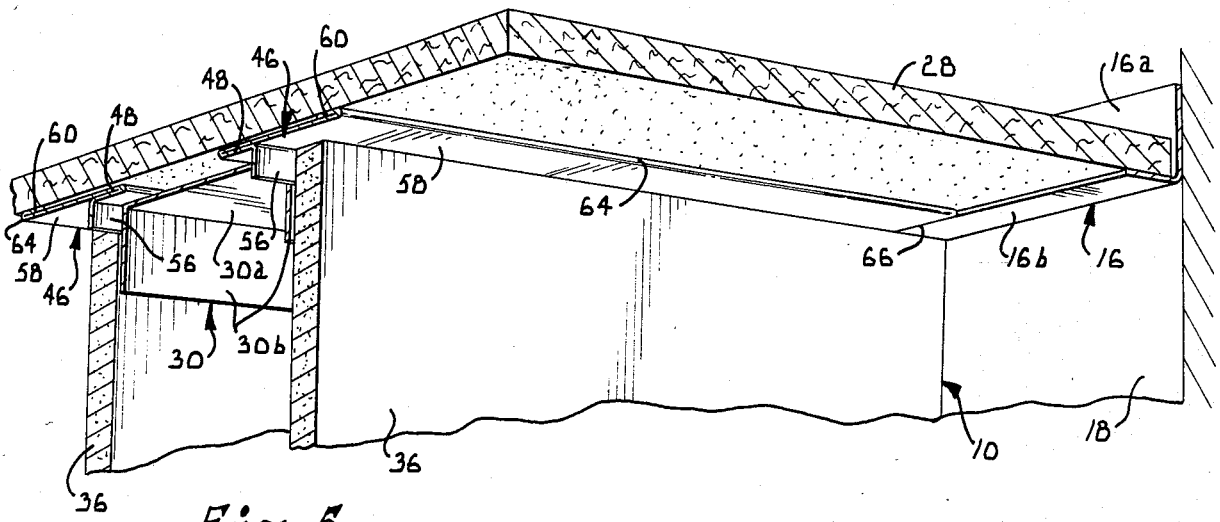
Fig. 5.
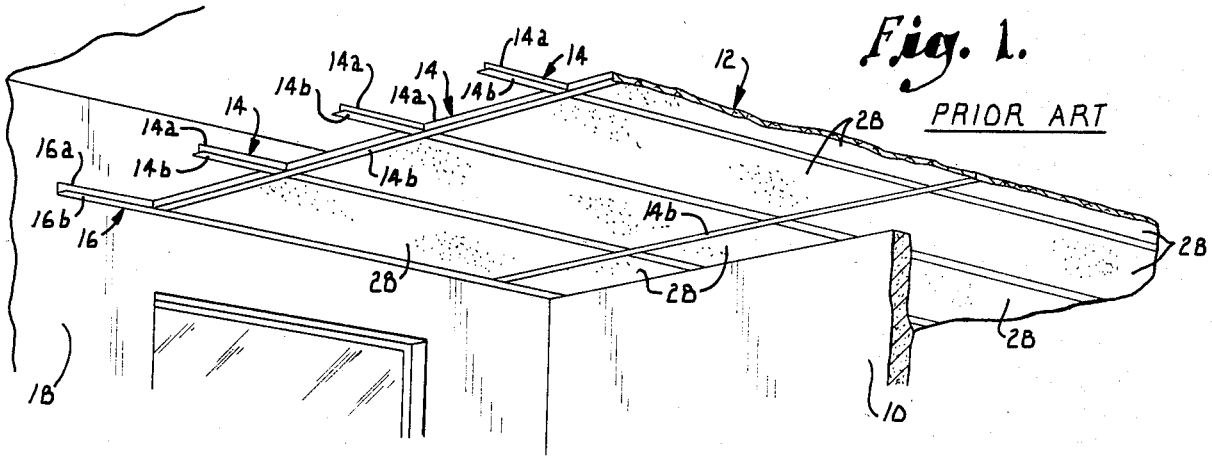
Fig. 1.
Fig. 6.
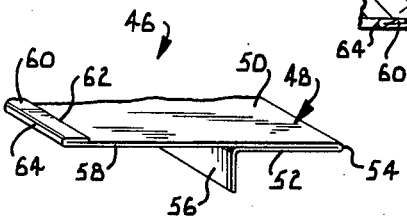
Fig. 7.
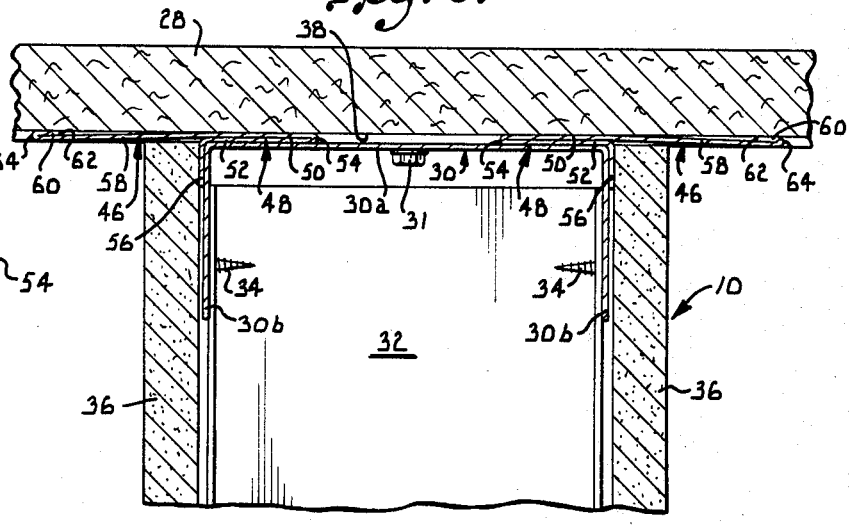

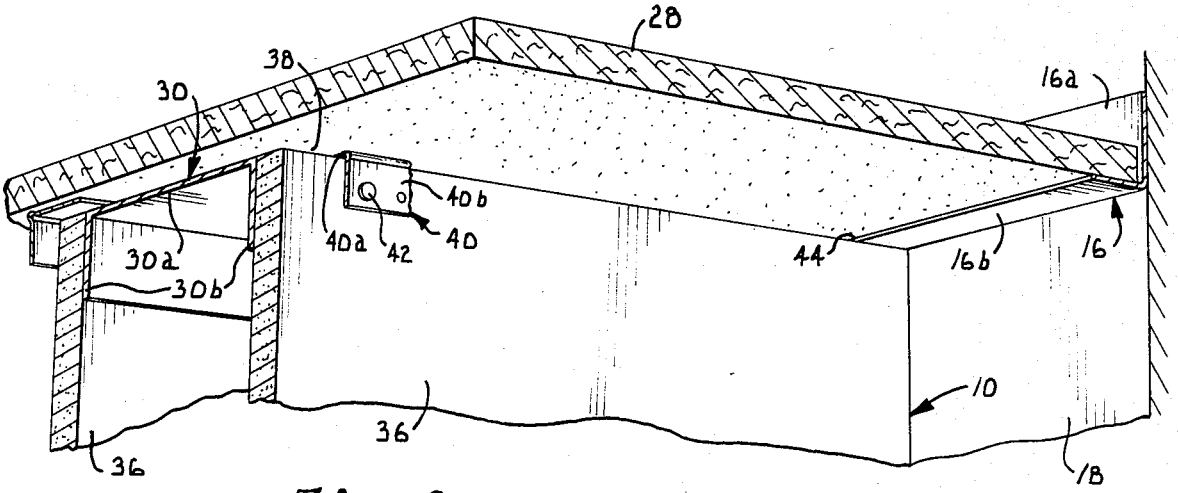
Fig. 2
PRIOR ART
Fig. 3.
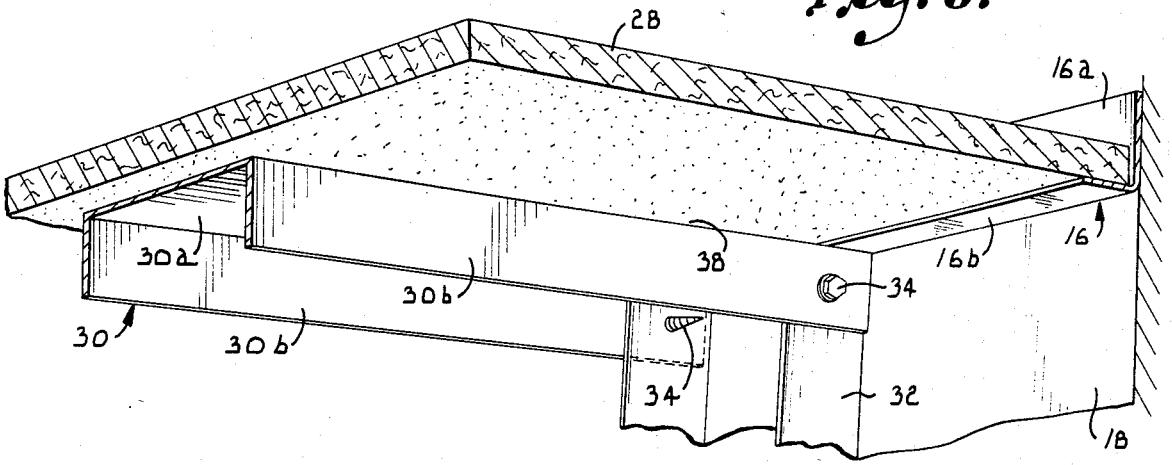
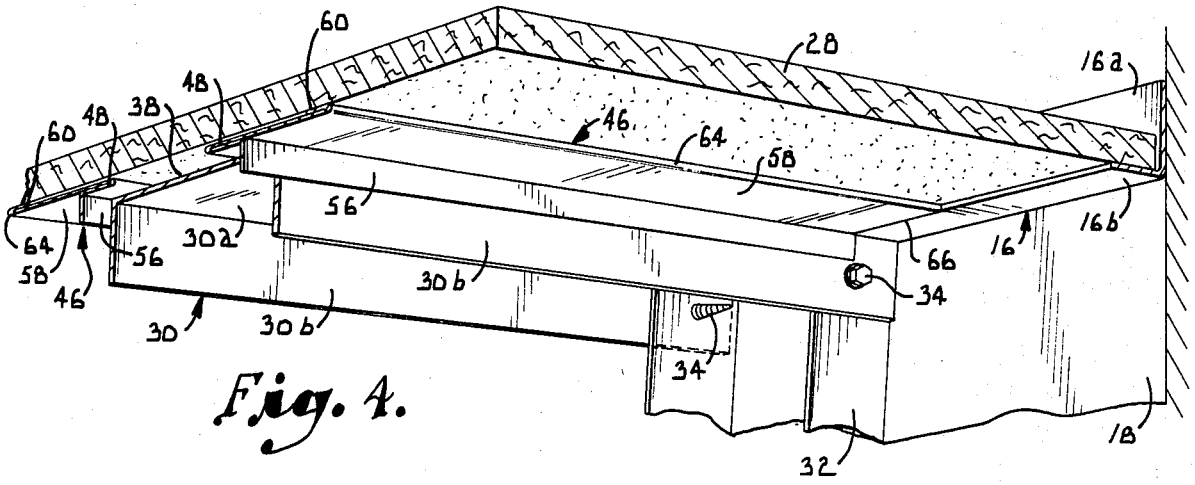
Fig. 4.

TRIM PIECE FOR SUSPENDED CEILINGS

BACKGROUND OF THE INVENTION

This invention relates to a trim structure for installation at the joints formed between suspended ceilings and upright partitions.

In the construction of suspended ceilings, a series of main T-bars and cross T-bars are suspended from the main structural ceiling by hanger wires or other hangers. The T-bars are arranged to form an overhead grid on which rectangular ceiling tiles are supported. The edges of the ceiling tiles rest on the flanges of the T-bars and are thus easily removable to provide convenient access to the area above the suspended ceiling.

When the area below the suspended ceiling is to be partitioned, a wall track formed by an inverted metal channel is attached to the T-bars at the proper location. Channel shaped metal studs are then secured to the wall track at their top ends and to the floor or a sole plate at their bottom ends to provide the framework of the partition. Sheet rock or another type of wallboard is suitably secured to the framework and is taped and painted or otherwise finished to provide an attractive surface on the partition.

Although this type of construction has achieved considerable popularity, it has not been wholly without problems. One problem has been in the appearance of the joints between the ceiling and the partitions. The overhead wall track is secured against the bottom surfaces of the flanges of the T-bars and is thus spaced below the ceiling tiles by a distance equal to the thickness of the T-bar flanges, leaving a crack between the ceiling and the wall track.

In order to eliminate the crack, angle members are usually installed at the joints to fill the crack and provide a base for applying drywall tape right up to the ceiling tiles. The sheet rock is applied such that its top edge is even with the top of the wall track. An angle member is then installed between each pair of T-bars with one flange of the angle filling the crack above the sheet rock and the other flange lying along the sheet rock surface immediately below its top edge. The exposed flange of the angle is taped so that the finished surface of the partition extends up to the ceiling tiles.

Even when this procedure is properly followed and good craftmanship is used, the attractiveness of the partition suffers due to the presence of steps at each T-bar where the top edge of the partition drops down from the ceiling tile to the lower surface of the T-bar flange and then rises back up to the next ceiling tile on the other side of the T-bar. This stepped configuration gives the partition an uneven top edge which detracts considerably from its overall appearance. It is also necessary to fully cover the angle member with drywall tape and joint compound which necessitates taping up against the ceiling tiles. The partition must then be painted or otherwise finished or covered with wall paper or wall covering right up to the ceiling tiles. Consequently, drywall compound and paint can easily be splattered on the adjacent ceiling tiles and can ruin them and require replacement.

SUMMARY OF THE INVENTION

In accordance with the present invention, the joints between the ceiling tiles and partitions are provided with uniquely shaped trim pieces which are applied to the overhead wall track. Each trim piece has a body portion which fits closely between the web of the wall track and the overlying ceiling tile. A flat tongue extends from the body portion downwardly along the downturned flange of the wall track. When wallboard is applied in the usual manner to the framework of the partition, a horizontal flange portion of the trim piece projects outwardly through the crack that is formed between the ceiling tile and the upper edge of the wallboard. The flanges of the trim piece extend between and are coplanar with the flanges of the T-bars to provide attractive trimming for the joints which mates well with the other exposed parts of the ceiling grid system.

In addition to improving the appearance of the joints, the trim pieces also make it easier to finish the wall board and eliminate the splattering of paint and joint compound on the ceiling tiles. The wallboard can easily be taped and painted right up to the projecting flange of each trim piece, and any splattering will occur on this flange rather than on the ceiling tile. The trim piece preferably has a finished metal surface from which splattered liquids can easily be removed simply by wiping. Consequently, the fiber board ceiling tiles are protected against splattering and are not as likely to require replacement as when other techniques are used to finish the joints.

DETAILED DESCRIPTION OF THE INVENTION

In the accompanying drawings which form a part of the specification and are to be read in conjunction therewith and in which like reference numerals are used to indicate like parts in the various views:

FIG. 1 is a fragmentary perspective view showing a suspended ceiling and a vertical partition constructed according to the prior art;

FIG. 2 is an enlarged perspective view showing the manner in which the joints between the ceiling and partitions are typically finished in accordance with the prior art;

FIG. 3 is a fragmentary perspective view showing an overhead wall track applied to a suspended ceiling and connected to the top of a vertical wall stud in accordance with normal construction techniques;

FIG. 4 is a fragmentary perspective view showing a pair of trim pieces constructed according to the present invention installed at the joints formed between the suspended ceiling and the opposite side flanges of the wall track;

FIG. 5 is a fragmentary perspective view similar to FIG. 4 but showing wallboard panels applied to the opposite sides of the wall track and stud to form the opposite surfaces of the partition;

FIG. 6 is a fragmentary sectional view on an enlarged scale showing the top portion of the finished partition with the trim pieces in place; and FIG. 7 is a fragmentary perspective view of one of the trim pieces showing its preferred configuration.

Referring now to the drawings in detail, FIGS. 1 and 2 illustrate the manner in which an upright partition 10 is joined to a suspended ceiling 12 in accordance with the prior art. The suspended ceiling includes a plurality of T-bars 14 which are suspended from the overlying true ceiling on hanger wires or similar hangers (not shown). The T-bars 14 are arranged into main tees and cross tees which are perpendicular to one another and which cooperate to form a grid pattern. The grid includes angle members 16 which are suitably secured to the main walls 18 of the building. Each T-bar 14 has a vertical web 14*a* and a horizontal flange 14*b* which cooperates with web 14*a* to provide an inverted T shape. Each of the wall angles 16 has a vertical flange 16*a* secured against wall 18 and a horizontal flange 16*b* which cooperates with the T-bar flanges 14*b* to receive the edges of rectangular ceiling panels or tiles 28 supported on the grid system. The ceiling tiles 28 are formed from fiber board or a similar material.

The structure of each partition 10 is best shown in FIG. 2. At the top of the partition, a wall track 30 in the form of an inverted channel is secured to the overlying T-bars 14 and angle members 16. Each wall track 30 has a flat, horizontal web 30*a* which is secured against the lower surfaces of the flanges 14*b* and 16*b* by suitable fasteners 31 (FIG. 6). A pair of flanges 30*b* extend downwardly from the opposite sides of the web 30*a*. The framework of the partition includes a plurality of vertical studs 32 (see FIG. 3), each formed by a channel member. The top end of each stud 32 is secured to the wall track 30, as by means of screws 34 or similar fasteners.

The outer surfaces of the partition 10 are formed by panels of sheet rock 36 or another type of wallboard. The sheet rock panels are secured to the framework formed by the wall track 30, the studs 32, and a sole plate (not shown).

Since the wall track 30 is secured to the undersides of the flanges 14*b* and 16*b*, the web 30*a* is spaced below the overlying ceiling tile 28 by a distance equal to the thickness of the flanges 14*b* and 16*b*. Accordingly, a crack 38 is formed between the ceiling tile 28 and the web 30*a*. The technique most often used to eliminate the crack 38 involves placement of an angle member 40 at the joint formed between the ceiling tile 28 and the top edge of the sheet rock 36. A horizontal flange 40*a* of the angle member is inserted into the crack to fill it and provide a base for finishing the sheet rock right up to the panel 18. A vertical flange 40*b* of the angle member extends downwardly along the outside surface of the sheet rock 36 immediately below its top edge. The angle member 40 can be secured to the sheet rock by suitable fasteners 42. In order to cover the flange 40*b*, finishing of the partition surface requires that drywall tape and joint compound be applied to the flange 40*b* right up to the ceiling tile 28. FIG. 2 depicts a partition surface which is partially finished in accordance with this prior art technique.

Even when good workmanship is used and this procedure is properly followed, the upper edge of the partition has a stepped configuration caused by the offset between the lower surface of each ceiling tile 28 and the lower surfaces of the flanges 14*b* and 16*b*. For example, a step 44 is formed at the edge of the flange 16*b* and also at each edge of each of the T-bar flanges 14*b*. This stepped configuration of the top edge of the partition detracts considerably from its overall appearance.

The present invention provides a trim piece which is generally designated by numeral 46 and which eliminates the undesirable stepped configuration of the partition.

The configuration of the trim piece 46 is best shown in FIG. 7. A generally flat body 48 is formed by an upper plate 50 and an underlying bottom plate 52 which is integral with plate 50. Plate 52 is doubled back on and bent beneath plate 50 such that the two plates are connected by a smooth bend 54 which forms one edge of the trim piece 46. Integral with the bottom plate 52 at the edge opposite the bend 54 is a downturned tongue 56 which is perpendicular to body 48 and both plates 50 and 52. The tongue 56 is a flat, plate-like member.

A flange portion 58 of the trim piece 46 forms a continuation or extension of the upper plate 50 and is the only exposed part of the trim piece. The flange 58 is flat and is integral with the upper plate 50 of the body 48. Flange 58 has a thickness which is equal to the thickness of each of the flanges 14*b* and 16*b* of the T-bars and angles which form the grid system of the ceiling 12.

The free edge of flange 58 is bent or rolled such that a short lip 60 is bent back on and located above the flange 58. The lip 60 terminates in a free edge 62, and its bent connection with flange 58 provides an attractive rolled edge 64 which extends the entire length of the trim piece 46. The trim piece has the general shape of a T in section with the tongue 56 forming the leg of the T.

The manner in which the trim piece 46 is used is best shown in FIGS. 3–6. After the wall track 30 and studs 32 have been secured in place, the trim pieces 46 are installed in the cracks 38 presented between the wall track 30 and the ceiling tiles 28. Preferably, the trim piece 46 is formed from a single plate member which is suitably bent to present the trim piece with the proper configuration. The trim pieces are cut to have the proper length to extend between each pair of flanges 14*b* (or between the flange 16*b* of the angle member 16 and the next T-bar flange 14*b*). The opposite ends of each trim piece 46 butt up against the flanges 14*b* and 16*b*, as indicated by the butt joint 66 shown in FIGS. 4 and 5.

Each trim piece extends generally along the wall track 30. The body 48 of each trim piece is fitted closely into the crack 38 formed between the upper surface of the wall track web 30*a* and the overlying ceiling tile 28. The body is inserted into the crack 38 until the downturned tongue 56 contacts the flange 30*b* of the wall track. The trim piece is then in the position shown in FIG. 4.

After the trim piece 46 has been installed in the manner indicated, the sheet rock 36 is applied to the frame members formed by the wall track 30, the studs 32 and the sole plate (not shown). As shown in FIGS. 5 and 6, each sheet rock panel has its top edge butting against the flange 58 so that the tongue 56 is closely sandwiched between the wall track flange 30*b* and the sheet rock 36. The flange 58 extends closely between the top edge of the sheet rock 36 and the ceiling tile 28 and projects outwardly beyond the outer surface of the sheet rock along the underside of the ceiling tile. The sheet rock panels are secured to the frame members of the partition in the usual manner, and the sandwiching of the tongue 56 between the sheet rock and wall track secures the trim piece in place.

Thus, the trim piece eliminates any crack at the joint formed between the ceiling tiles and the top of the partition. As best shown in FIG. 5, the flange 58 is the only part of the trim piece which is exposed, and it matches well with the flanges 14*b* and 16*b* which are the only exposed parts of the grid system. The joint above each partition thus has the same appearance as the joints between the ceiling and the main walls 18 formed by the flanges 16*b* of the angle members 16. The lip 60 and its free edge 62 are located above flange 58 at an unexposed location, and the rolled edge 64 provides an attractive finished edge which matches well with the finished edges of the flanges 14*b* and 16*b*. Preferably, flange 58 projects outwardly beyond the sheet rock the same distance as the flanges 14*b* and 16*b*.

The sheet rock 36 can be taped and finished right up to the projecting flange 58 of each trim piece. This assures that the joints will be attractive and that no crack will be presented at any of the joints. Also, any joint compound or paint or other finishing material which is splattered will not reach the ceiling tiles but will instead splatter onto the flange 58 from which it can be easily removed simply by wiping. Preferably, the trim piece 46 is formed from metal which matches with the metal T-bars 14 and angles 16 in color and finish.

The body portion 48 of the trim piece has a double plate construction formed by the upper and lower plates 50 and 52 which enhances its strength. The edge portion of flange 58 is similarly strengthened by the lip 62. The close fit of body portion 48 in the crack 68 maintains the trim piece securely in place while the sheet rock or wallboard is being applied. Once the wallboard is in place, the downturned tongue 56 assures that the trim piece is securely held in a stationary position. Accordingly, no fasteners are required for the trim piece.

It should be noted that the partition 10 can be oriented either parallel to the main T-bars or to the cross T-bars. In either event, one of the trim pieces 46 extends continuously between each pair of T-bars so that the joint at the top of the partition appears identical to the joint at the top of each main wall 18 of the building.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, we claim:

1. A trim member for application to a joint between a suspended ceiling tile supported on flanges of a pair of overhead T-bars and a vertical partition oriented transversely to the T-bars and formed by wallboard covering an overhead wall track having a flange portion and a web portion extending between the T-bars against the undersides of their flanges, said trim member comprising:

a generally flat body portion having a length to extend between the flanges of the T-bars and a size to fit closely between the ceiling tile and the web portion of the wall track;

a tongue portion projecting from said body portion and oriented generally perpendicular thereto, said tongue portion being adapted for placement between the flange portion of the wall track and the wallboard to retain the trim member in a stationary position; and a generally flat flange element having substantially the same thickness as the flanges of the T-bars and having a length to extend between the flanges in butting relation thereto, said flange element extending from said body portion at a location to extend through the joint between the ceiling tile and wallboard and along the underside of the ceiling tile beyond the wallboard, said flange element being permanently attached to said body portion and having a finished surface which remains exposed following application of the trim member to the joint.

2. The invention of claim 1, including:

a free edge portion of said flange element remote from said body portion; and a lip on said free edge portion bent above and back on said free edge portion of the flange element and termination in a free edge located above said flange element to be shielded thereby, said lip having a finished surface and being exposed following application of the trim member to the joint.

3. The invention of claim 1, wherein said body portion includes a top plate from which said flange element extends and a bottom plate having a bend connection with said top plate, said bottom plate extending along the underside of the top plate to provide the body portion with a double plate construction.

4. The invention of claim 3, wherein said top and bottom plates are integral with one another and said flange element is integral with said top plate and forms a continuation thereof.

5. The invention of claim 4, including a lip on said flange element bent back above same and terminating in a free edge overlying said flange element.

6. The invention claim 3, wherein said tongue portion extends from said bottom plate.

7. The invention of claim 6, wherein said top and bottom plates are integral with one another and with said flange element and tongue portion.

8. In a building construction of the type which includes a suspended ceiling formed by a plurality of ceiling tiles supported on flanges of overhead members arranged in a grid pattern, and a partition formed by wallboard applied to an overhead wall track having a web portion extending between selected overhead members against the undersides of the flanges thereof and a flange portion of the wall track extending from the web portion thereof, the improvement comprising:

a plurality of trim members applied to the joints formed between the wallboard and the ceiling tiles supported on said selected overhead members;

a body portion of each trim member, each body portion having a generally flat shape and being sandwiched between the web portion of the wall track and the overlying ceiling tile;

a tongue portion of each trim member projecting downwardly from the body portion thereof between the wallboard and said flange portion of the wall track; and a flange element on each trim member extending from the body portion thereof between and in a common plane with the flanges of the overhead members supporting the overlying ceiling tile, each flange element having a generally flat shape and extending through and substantially filling the joint between the wallboard and overlying ceiling tile and extending along the ceiling tile beyond the wallboard, said flange element being permanently connected to said body portion and having a finished surface which remains exposed after the trim member has been applied to its joint.

9. The improvement of claim 8, wherein the body portion of each trim member includes a pair of plates doubled back on one another to provide a double plate construction.

10. The improvement of claim 8, wherein said double plate construction includes a top plate from which the flange element extends and a bottom plate underlying said top plate and connected therewith at a bend connection.

11. The improvement of claim 10, wherein each flange element forms an integral continuation of the corresponding top plate.

12. The improvement of claim 10, wherein said tongue portion is bent from the bottom plate at substantially a right angle.

13. The improvement of claim 8, wherein said body portion, tongue portion and flange element of each trim member are formed in a single integral piece.

14. The improvement of claim 8, including:

a free edge portion of each flange element remote from the body portion; and a lip on the free edge portion of each flange element, each lip being bent back on the flange element and having a smooth bend connection therewith and each lip terminating in a free edge located between the flange element and ceiling tile at an unexposed location.

15. In a wall and ceiling system having a suspended ceiling which includes a plurality of generally parallel overhead support members having flanges supporting ceiling tiles and a partition wall which includes wallboard applied to an overhead wall track having a vertical flange portion and a horizontal web portion extending transversely to the supported members and disposed against the undersides of the flanges thereof, the improvement comprising:

a trim member extending transversely between each adjacent pair of support members;

a flat body portion of each trim member sandwiched between the overlying ceiling tile and the web portion of the wall track;

a tongue on each trim member extending substantially perpendicular to the body portion thereof and closely sandwiched between the wallboard and the flange portion of the wall track to secure the trim member at the corresponding joint; and a flat flange element on each trim member projecting from the body portion thereof closely between the upper edge of the wallboard and the overlying ceiling tile and extending along the underside of the ceiling tile beyond the wallboard, each flange element having opposite ends located in abutting relationship to the flanges of the support members between which the flange element extends, each flange element being permanently connected with the body portion of the corresponding trim member and having an exposed surface which is finished.

16. The invention of claim 15, including a lip on said flange element turned back on the flange element and having a smoothly curved connection therewith, said lip terminating in a free edge disposed between the flange element and ceiling tile at an unexposed location.

17. The invention of claim 15, wherein the body portion of each trim member includes a pair of plates overlying one another to strengthen said body portion.

18. The invention of claim 17, wherein each pair of plates includes:

a flat upper plate from which the flange element extends to form a continuation of the upper plate; and a flat lower plate underlying said upper plate and having a smoothly curved connection therewith.

19. The invention of claim 18, wherein said tongue extends from said lower plate and is integral therewith.

20. The invention of claim 15, wherein said body portion, flange element and tongue cooperate to form the general shape of a T.

* * * * *